US005879248A

United States Patent [19]

Marsico

[11] Patent Number: 5,879,248

[45] Date of Patent: Mar. 9, 1999

[54] STRINGED SPORTS RACQUET INCORPORATING INTERLOCKING STRING CLAMPS

[76] Inventor: Peter Joseph Marsico, 112 Prestwick Place, Cary, N.C. 27511

[21] Appl. No.: 979,359

[22] Filed: Nov. 26, 1997

[51] Int. Cl.[6] ..... A63B 49/00; A63B 51/14

[52] U.S. Cl. ..... 473/534; 473/539

[58] Field of Search ..... 473/539, 540, 473/541, 534, 178, 179

[56] References Cited

U.S. PATENT DOCUMENTS

| | | | |
|---|---|---|---|
| 1,336,030 | 4/1920 | Gammeter | 473/540 X |
| 1,526,734 | 2/1925 | Andrews et al. | 473/540 |
| 2,080,642 | 5/1937 | Timipe | 473/540 |
| 4,309,033 | 1/1982 | Parker, Jr. et al. | 473/540 |
| 4,333,649 | 6/1982 | Vaughn et al. | 473/540 |
| 4,741,531 | 5/1988 | Szedressy | 473/540 |
| 4,928,963 | 5/1990 | Garbosch | 473/540 |
| 5,667,216 | 9/1997 | Gunn | 473/540 |

FOREIGN PATENT DOCUMENTS

| | | | |
|---|---|---|---|
| 50041 | 3/1935 | Denmark | 473/178 |
| 3506025 | 8/1986 | Germany | 473/178 |
| 23260 | 10/1908 | United Kingdom | 473/178 |
| 887526 | 1/1962 | United Kingdom | 473/178 |

*Primary Examiner*—Raleigh W. Chiu
*Attorney, Agent, or Firm*—Rhodes, Coats & Bennett

[57] ABSTRACT

The sports racquet of the present invention utilizes a series of interlocking string clamping assemblies which are adapted to be received within a corresponding series of passageways formed in the surrounding frame structure of the racquet, and wherein each clamping assembly is adapted to receive and grip a length of playing string which passes therethrough. The clamping assembly is generally comprised of a gripping wedge member and a clamping member, wherein the gripping wedge includes a fastener which secures the wedge to the racquet frame structure prior to application of the clamping member. With the gripping wedge member so positioned and secured within the frame structure, the clamping member is inserted between the wedge and the frame passageway, thereby causing the wedge member to engage and grip the adjacently disposed segment of playing string. In a preferred embodiment, the clamping member is equipped with a fastener which secures the clamping member to the wedge upon completion of the clamping member insertion process.

32 Claims, 5 Drawing Sheets

STRINGED SPORTS RACQUET INCORPORATING INTERLOCKING STRING CLAMPS

FIELD OF THE INVENTION

This invention relates to stringed sports racquets and the maintenance of string tension in such string bearing devices, more particularly to a string sports racquet which incorporates a series of interlocking string clamps.

BACKGROUND OF THE INVENTION

Tennis racquets are typically composed of a rigid frame which supports one or two continuous lengths of string woven into a pattern of main (vertical) and cross (horizontal) segments, with the ends of each length of string secured by a knot. Continuous one-piece knot secured stringing methods utilize a single continuous length of string that is used for weaving both mains and crosses, while continuous two-piece knot secured stringing methods require a separate length of string for the mains and the crosses.

During the racquet stringing process, string tension is set by an external tensioning device and the string segment is then clamped to temporarily retain the tension while the process is repeated for the next un-tensioned main or cross segment. The overall length of string is secured via the placement of knots at each of the free ends of the string.

The continuous knot secured stringing methods suffer from a number of disadvantages. As the disadvantages are similar for both the one and two-piece continuous knot secured methods, only the one-piece method will be discussed below. Since all of the main and cross segments are woven from the same single continuous length of string, any segment specific tensioning errors will tend to be communicated to all other segments that are necessarily composed of that length of string. As a result of this inter-segmental communication, successive tensioning errors will tend to combine in an additive manner and be distributed to some degree throughout the woven racquet face.

During the stringing process, common sources of tensioning error include: frictional forces and variations in these forces generated at the main and cross segment intersection points, frictional forces and variations in these forces generated at the pass-through points on the racket frame, and slippage of the strings within the temporary restraining clamps.

Furthermore, the knot tying process is inherently error prone in that the free end of the string must be removed from the tensioning device prior to the actual tying of the knot. In this case, once removed from the tensioning device, the string must be temporarily restrained without loss of tension while the final string routing and knot tying steps are performed. In practice, this is difficult to accomplish accurately and consistently. Consequently, with one or even two-piece knot secured stringing methods, it is difficult to accurately control and maintain tension over the entire length of the weave during the racquet stringing process.

Additionally, the continuous nature of the weave imposes serious limitations on segment specific tension variability. In the most restrictive case, the one-piece continuous knot secured method necessarily requires that every segment in the weave have the same tension. The two-piece continuous knot secured method is slightly less restrictive in that it allows the mains and the crosses to be independently tensioned. In either case, there is little opportunity for racquet users or designers to explore the potential benefits of segment specific tensioning.

The continuous nature of the weave also imposes serious limitations on segment specific string composition. In the most restrictive case, the one-piece continuous knot secured method necessarily requires that every segment in the weave be composed of the same string type and size. The two-piece continuous knot secured method is slightly less restrictive in that it allows the mains and the crosses to be composed of two string types and sizes. In either case, there is little opportunity for racquet users or designers to explore the potential playability and durability benefits of completely independent segment string types and sizes.

Tensioning of each segment requires that the free end of the string be placed in the gripper or gripping jaw of a tensioning device. Once the string is secured in the gripping jaw, the tensioning device is engaged thus applying tension to the length of string contained therein. In a one-piece continuous knot secured stringing method, nearly all incidental abrasions inflicted upon the string by the gripping jaws of the tensioning device will be incorporated into the body of the weave at some point during the stringing process. These abraded areas of the string are points of stress concentration and are consequently more likely to experience a breaking failure.

Furthermore, as all of the main and cross segments are woven from the same single length of string, the failure of any single main or cross segment requires that all segments be replaced. This is tremendously inefficient with regards to both the time and the materials required to re-string a racquet.

It is known that U.S. Pat. Nos. 4,309,033 and 4,333,649 disclose a wedge shaped member which is disposed between the racquet frame and the length of string passing therethrough, so as to engage and secure the string. However, the approach taken in these prior art disclosures necessarily requires the wedge member to engage and begin gripping the string segment prior to final positioning of the wedge within the frame passageway, and consequently prior to final positioning of the wedge with respect to the string segment. This early or premature engagement of the gripping wedge may lead to scoring or abrasion of the string surface, which may ultimately weaken the string and result in a breaking failure under playing conditions. Furthermore, premature engagement of the wedge member also necessarily interferes with the ability to accurately maintain the string segment at a predetermined tension during the stringing process. That is, as the wedge is inserted into the passageway of the frame and begins to prematurely engage the string segment therein, the portion of the string being engaged by the wedge will tend to be pulled in the direction of movement of the gripping wedge. Obviously, any pulling or pushing force applied along the axis of the string segment during the securing process will necessarily affect the tension of that string segment.

Additionally, the wedged string clamping devices described in the above mentioned prior art, have no way of preventing the gripping wedge from backing out of passageway once insertion is complete and final positioning of the wedge has been accomplished. Any tendency of the wedge member to back out of the frame passageway once final positioning has been achieved, will necessarily result in a loss of tension in the secured segment of string.

Therefore, there is and continues to be a need for a practical and economical stringed sports racquet wherein each main and cross segment of the woven racquet face can be comprised of a separate, independent length of string and whereby each string segment can be quickly, accurately and independently tensioned and secured.

SUMMARY OF THE INVENTION

The present invention entails a stringed sports racquet generally comprising an elongated handle and a surrounding frame structure which forms a racquet playing face and wherein the frame structure includes a series of spaced apart passageways formed therein. Adapted to be received within the racquet frame passageways are a series of interlocking string clamping assemblies wherein each clamping assembly includes a gripping wedge having a longitudinal throughway for receiving a length of string associated with the sports racquet and wherein the gripping wedge additionally includes a fastener for generally securing the wedge member directly to the passageway such that the wedge engages and is seated or secured within the passageway. Also included with each clamping assembly is a clamping member for engaging the gripping wedge and clamping the wedge down on the string for securing the string within the wedge and consequently within the frame structure of the sports racquet. The clamping member further includes a fastener for engaging and connecting to the gripping wedge such that the clamp and wedge are secured together within the passageway of the frame structure of the sports racquet.

Implementation of the interlocking string clamping system involves insertion of a string segment through the throughway of the gripping wedge and insertion of the wedge into a respective passageway in the racquet frame structure. Following insertion and positioning of the gripping wedge within the frame passageway, the clamping member is inserted between the wedge and the passageway, thereby clamping the wedge against the string segment passing therethrough.

In one particular embodiment, the gripping wedge member of the interlocking string clamping system is configured as a conical jaw assembly comprising a pair of cooperating wedge shaped jaw members. The clamping member is configured as a generally cylindrical sleeve comprising a conical shaped interior wall which is adapted to generally surround, engage, and force closure of the conical jaw assembly upon insertion into a passageway of the racquet frame structure. Following full closure of the jaw assembly on the adjacent string segment, the jaw assembly and corresponding sleeve are adapted to be fastened together so as to interlock and generally resist further relative movement of the components.

DETAILED DESCRIPTION OF THE INVENTION

Figure 1:
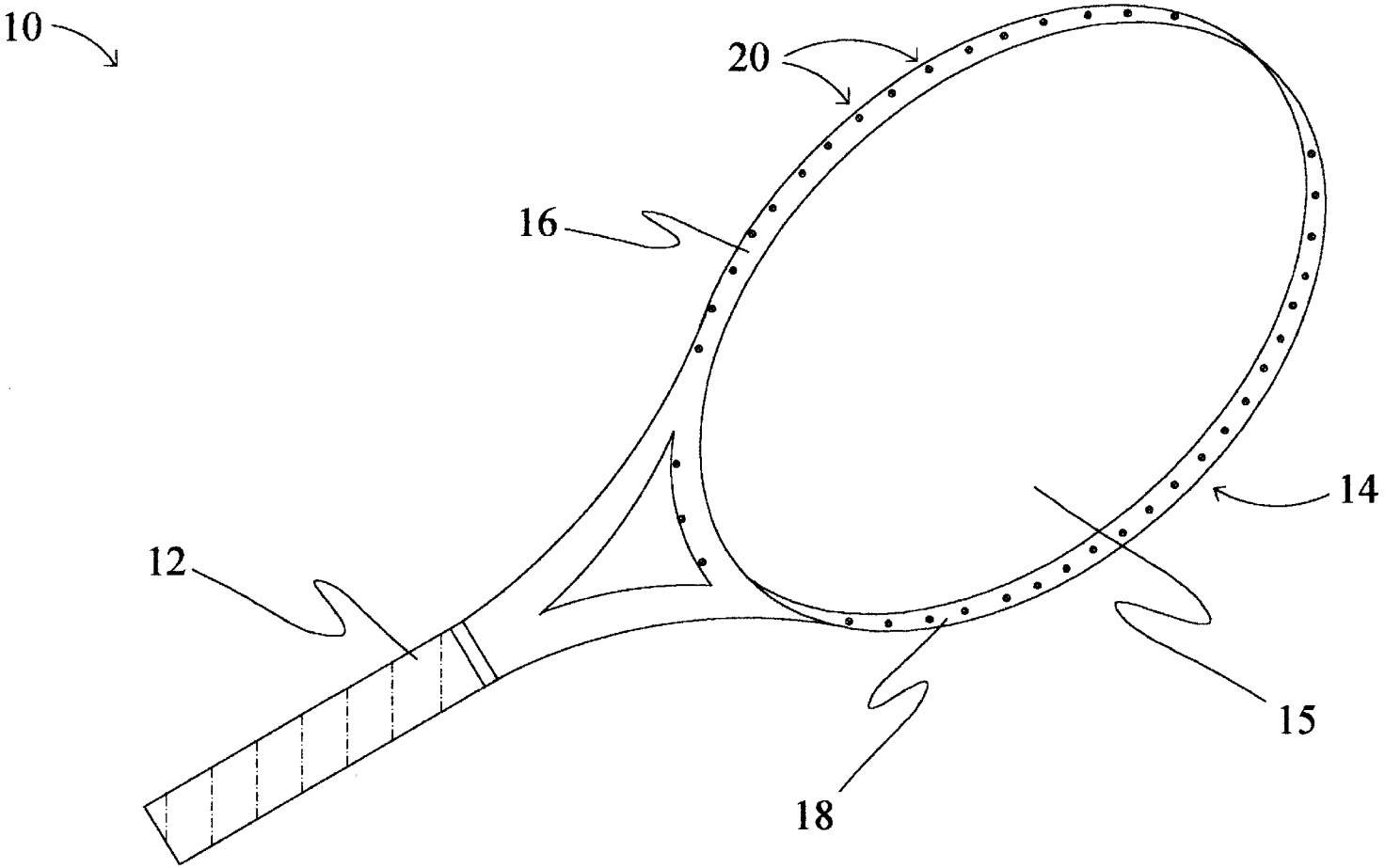
FIG. 1 is a perspective view of a stringed sports racquet of the type generally contemplated for use with the interlocking string clamp apparatus of the present invention.
Figure 2:
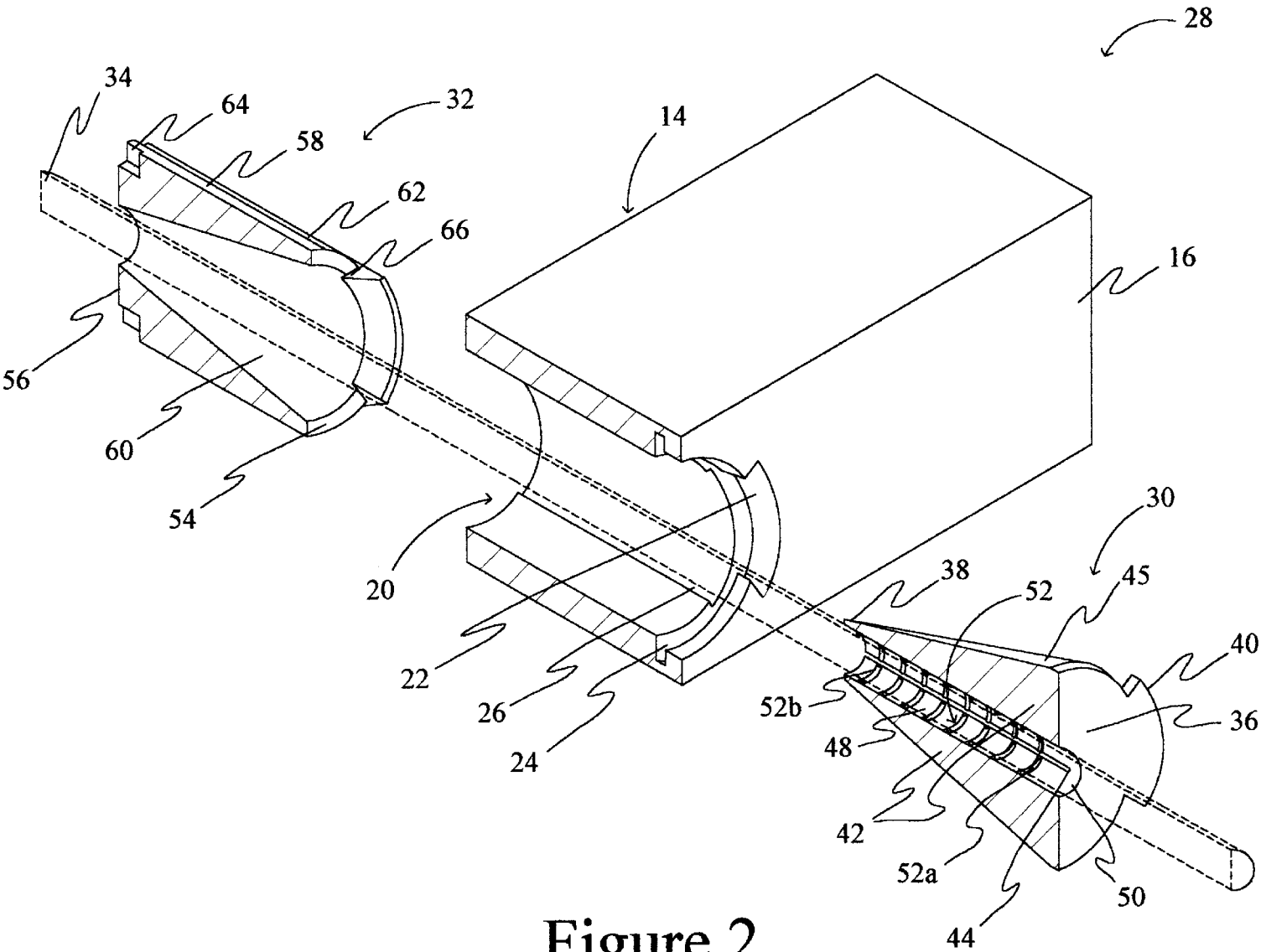
FIG. 2 is an exploded and sectioned, perspective view of the preferred embodiment of the interlocking string clamp apparatus of the present invention, illustrating the racquet frame, jaw assembly and clamping sleeve components prior to engagement of the clamping apparatus.
Figure 3:
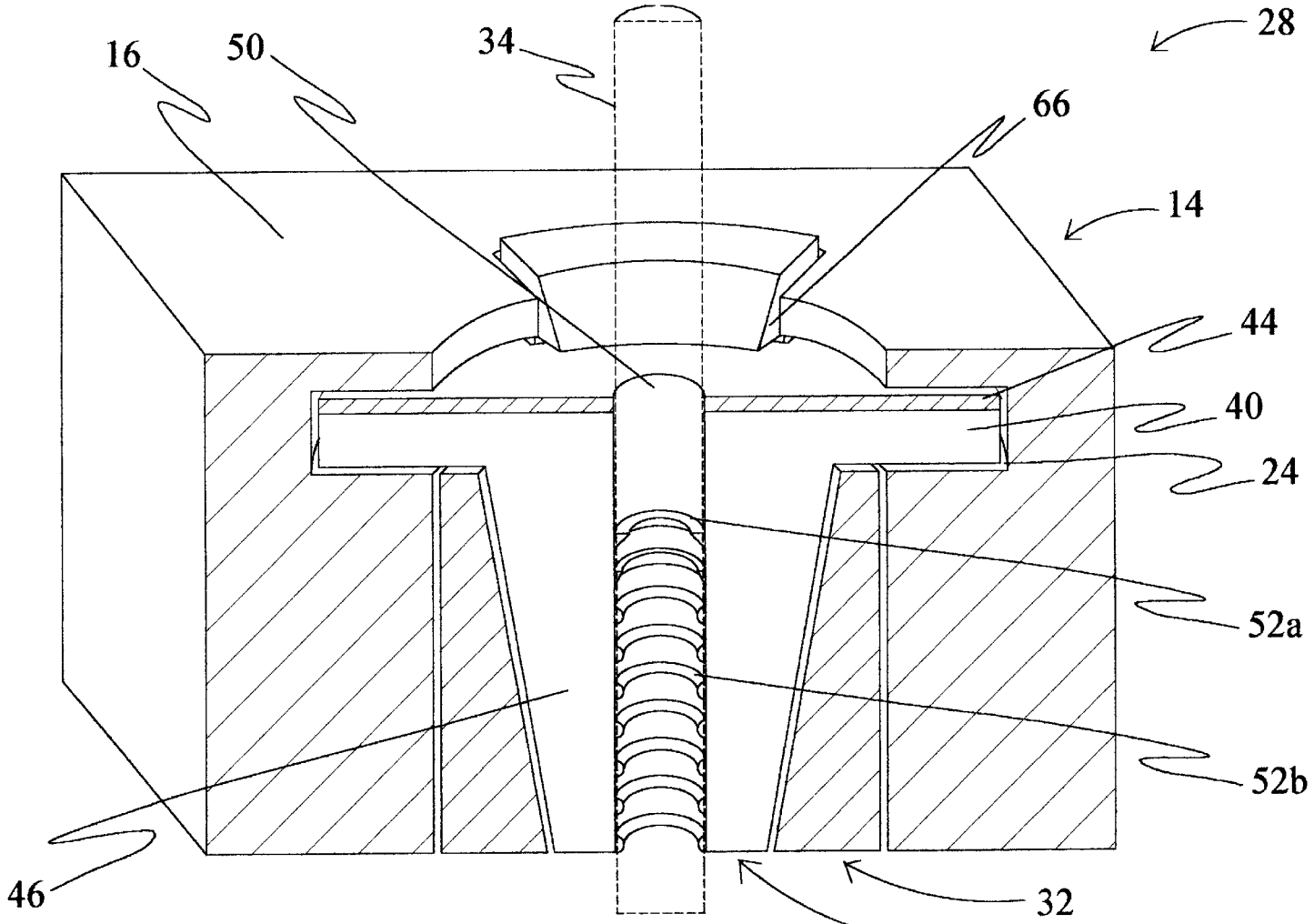
FIG. 3 is a sectioned, perspective view of the preferred embodiment of the interlocking string clamp apparatus of the present invention, illustrating the racquet frame, jaw assembly and clamping sleeve components following engagement and interlock of a clamping member fastener which secures the clamping member to the jaw assembly.

According to the present invention, a stringed sports racquet generally indicated by the numeral 10 is provided and shown in FIG. 1. The stringed sports racquet 10, herein referred to as the racquet, is comprised of a handle 12 and a frame structure, indicated generally by the numeral 14. The frame structure 14 defines a generally oval racquet face area 15 that is adapted to house a playing surface which is typically woven of playing string material. Furthermore, frame 14 contains an exterior face 16 and an interior face 18 which are communicatively coupled via a series of generally cylindrical passageways, indicated generally by the numeral 20. Adapted so as to be received and incorporated within a passageway 20 is an interlocking string clamp apparatus, generally indicated by the numeral 28, as illustrated in FIGS. 2 and 3. In a preferred embodiment, the interlocking string clamp apparatus 28 of the present invention comprises, in addition to the racquet frame 14 and associated passageway 20, a conical shaped wedge or jaw assembly generally indicated by the numeral 30, a compression or clamping sleeve generally indicated by the numeral 32, and a length of string 34 which is to be secured to the racquet frame 14.

As illustrated in FIG. 2, formed on the exterior face 16 of the frame, generally about the passageway 20 are a pair of symmetrically opposed indention's 22. Disposed so as to be in communication with the indention's 22 are a pair of circumferentially oriented grooves 24 formed in the passageway 20. A pair of symmetrically opposed longitudinal grooves 26 are also formed in the passageway 20 adjacent the indention's 22. Grooves 26 extend the entire length of the passageway 20, communicating with both the exterior and interior faces of the frame 16 and 18, respectively.

As further illustrated in FIG. 2, the jaw assembly 30 contains a generally widened top end 36 and a generally narrowed bottom end 38. Formed in and about the top end 36 of the conical jaw assembly 30 are a pair of symmetrically opposed fasteners or tabs 40. The jaw assembly 30 is generally comprised of a pair of tapered, cooperating jaw members 42 which are connected at the top end 36 through a formed hinge 44 which allows the opposing jaw members 42 to pivot with respect to one another, and hence, effectively facilitates opening and closing of the overall jaw assembly 30. Each jaw member 42 contains a tapered exterior surface 45 which is formed so as to provide the closed or engaged jaw assembly 30 with a generally conical shape. Each jaw member 42 also contains an inner face 46 which includes a longitudinally oriented throughway 48 that extends the entire length of the jaw member, and consequently communicates with both the top end 36 and the bottom end 38 of the overall jaw assembly 30. The throughways 48 of the opposing jaw members 42 are so aligned as to form a generally cylindrical gripping passageway 50 which extends through the jaw assembly 30 and which is adapted to receive and securely grip a length of string 34 when the jaw assembly 30 is closed or engaged. Disposed on the surface of the throughways 48 formed in each jaw member 42 is a series of grip enhancing protrusions in the form of ribs, generally indicated by the numeral 52. While the description and drawings provided herein refer to rib-type protrusions, in practice, such protrusions may assume the form of ribs, studs, or any functionally similar shape which generally enhances the gripping capability of the individual jaw members 42. Furthermore, as shown in FIGS. 2 and 3, the protrusions 52 may be formed so as to be either penetrating protrusions 52*a*, in which case the protrusions contact and penetrate the surface of the string segment 34 upon closure of the jaw assembly 30, or they may be non-penetrating protrusions 52*b*, in which case the protrusions make contact with, but do not penetrate the string surface upon closure of the jaw assembly 30.

The particular geometry and arrangement of the grip enhancing features or protrusions 52 which are formed on the gripping face of each jaw member throughway 48 are highly dependent on the tension and material properties of the string segment 34 that is to be secured. For instance, in a relatively low tension application a smooth gripping face, that is one containing no appreciable surface protrusions, may suffice and provide adequate gripping performance. However, higher tension applications may require the use of relatively smooth rounded, non-penetrating rib or stud type protrusions 52*b* formed on the surface of the gripping passageway 50. The degree of protrusion of each rib or stud may also vary with axial position along the gripping passageway 50, so as to effectively distribute the gripping stresses developed within the gripped string segment as previously disclosed in U.S. Pat. No. 4,309,033. Furthermore, as specifically illustrated in FIGS. 2 and 3, it may be necessary to utilize a combination of penetrating and non-penetrating protrusions 52*a* and 52*b* respectively, with the penetrating protrusions 52*a* preferentially positioned towards the rear of the gripping passageway 50, that is, towards the end of the gripping passageway which is ultimately situated closest to the exterior face 16 of the frame 14. With such a configuration, the forward positioned, nonpenetrating protrusions 52*b* will tend to effectively shield the tensile load from the rearward positioned, penetrating protrusions 52*a*. With the tensile load partially shielded by the non-penetrating protrusions 52*b*, the resulting stress concentrations caused by the penetrating protrusions 52*a* may be effectively reduced to a tolerable level, that is, a level which does not result in a catastrophic breaking failure of the string segment under normal tensile loading conditions.

The compression or clamping sleeve 32 is adapted so as to be received within the racquet frame passageway 20, generally surrounding the jaw assembly 30 and necessarily the string segment 34 passing therethrough. The sleeve 32 contains a top end 54 and a bottom end 56, as shown in FIG. 2. The exterior surface 58 of the sleeve 32 has a generally cylindrical shape which corresponds to the shape of the racquet frame passageway 20, while the interior surface of the sleeve 32 forms a generally conical shaped passageway 60, which communicates with both the top end 54 and the bottom end 56 of the clamping sleeve. Formed on the exterior surface 58 of the sleeve are a pair of tongues or rails 62 which protrude from the otherwise cylindrical surface. The clamping sleeve interior passageway 60 tapers from a larger diameter at the top end 54 to a smaller diameter at the bottom end 56 and generally coincides with the conical shape of the closed jaw assembly 30. Disposed symmetrically about the bottom end 56 of the sleeve 32, adjacent to the passageway 60 are a pair of grooves 64 for use by a clamping sleeve insertion tool (not shown). Disposed about the top end 54 of the sleeve are a pair of symmetrically opposed internal barbed tabs 66, wherein the barbs are directed inwards, towards the centerline of the conical passageway 60. The barbed tabs 66 are designed so as to deform, or be easily displaced during the insertion process, but resist deformation once final positioning of the clamping sleeve 32 relative to the jaw assembly 30 has been achieved.

Application of the interlocking string clamping apparatus 28 for restraint of a tensioned string segment 34 requires assembly of the components described above in a definite and well defined sequence. An exploded, perspective view of the initial, relative positioning of the components comprising the interlocking string clamp apparatus 28 is shown in FIG. 2. Prior to engagement, the compression sleeve 32 is positioned adjacent to the interior surface 18 of the frame 14 and threaded onto the string segment 34. When threaded onto the string segment 34 and slid into a position adjacent the frame 14, the sleeve 32 is oriented such that the top end 54 is exposed to the interior surface 18 of the frame 14. Furthermore, the sleeve 32 is oriented so as to align the tongues 62 with the corresponding grooves 26 located in the passageway 20 of the frame. In a similar manner, the jaw assembly 30, when threaded onto the string segment 34 and slid into a position adjacent the frame passageway 20, is oriented such that the tapered bottom end 38 is exposed to the exterior surface 16 of the frame. Furthermore, the jaw assembly 30 is oriented so as to align the fastening tabs 40 with the corresponding indention's 22 located on the exterior surface 16 of the frame.

Following initial, general positioning of the string segment 34, jaw assembly 30 and clamping sleeve 32, about the frame passageway 20, as described above, tension may be applied to and temporarily maintained on the string segment 34 by an external tensioning device (not shown). The opened and disengaged jaw assembly 30 is next slid down the string segment 34 until the fastening tabs 40 of the jaw assembly are seated within the indention's 22 formed in the exterior face 16 of the frame. Once seated, the entire jaw assembly 30 is rotated about the axis formed by the gripping passageway 50 until the fastening tabs 40 fully engage the circumferential retaining grooves 24, whereupon the jaw assembly 30 is effectively constrained from movement in either axial direction relative to the frame 14. Henceforth, it should be appreciated that, unless otherwise specified, references to axial movement of the string segment 34, the jaw assembly 30 or the clamping sleeve 32 are with respect to an axis that passes longitudinally through and is generally centered within the cylindrical frame passageway 20.

It should be noted that, while the jaw assembly 30 is constrained from movement in either axial direction by the circumferential retaining grooves 24 formed in the racquet frame structure as described above for the preferred embodiment, axial constraint of the jaw assembly prior to clamping may be accomplished, at least in part, through the use of external tools. For example, an alternate embodiment of the present invention could allow the jaw assembly to be seated within the racquet frame passageway such that securing features formed in the passageway prevent movement of the jaw assembly axially towards the racquet playing face. Then, prior to insertion of the clamping sleeve, an external tool could be applied to the jaw assembly which would prevent movement of the jaw assembly axially away from the racquet playing face. As such, the jaw assembly would be effectively constrained from movement in either axial direction, just as in the case of the preferred embodiment described above.

With the jaw assembly 30 secured within the circumferential retaining grooves 24 formed in the frame passageway 20, the compression sleeve 32 is slid up the string segment 34 until the sleeve tongues 62 align with and engage the longitudinal grooves 26 which are also formed in the passageway 20. Once proper alignment has been achieved between the sleeve 32 and the passageway 20, the sleeve is forcibly inserted into and through the passageway 20. It should be noted that the force required to fully insert the sleeve 32 may dictate the use of an insertion tool, the discussion of which is limited to general function, in that a typical insertion tool would engage the sleeve 32 through the pair of grooves 64, disposed generally about the bottom end 56 of the sleeve, and generate sufficient force so as to insert the body of the sleeve 32 into and through the passageway 20. Further details of the insertion tool are not described herein, as it is only the general function of the insertion tool that is relevant to the interlocking string clamp apparatus 28 of the present invention. As the sleeve 32 is forced into and through the passageway 20, towards the exterior face 16 of the frame, the internal passageway 60 of the sleeve generally surrounds and forcibly engages the exterior surface of the jaw assembly 30. Upon engagement, the conical internal passageway 60 of the sleeve 32 and the tapered exterior surfaces 45 of the opposing jaw members 42 interact such that a significant component of the sleeve insertion force is re-directed so as to cause the hinged jaw assembly members 42 to pivot into a closed or gripping configuration as the sleeve 32 proceeds into and through the passageway 20.

As the top end 54 of the sleeve 32 nears the top end 36 of the jaw assembly, the tips of the barb tabs 66 engage the exterior surface of the jaw assembly 30 and are forcibly deformed, thus allowing the top of the sleeve 32 and necessarily the tabs 66 to slip past the top of the jaw assembly 30. Once the tabs 66 have cleared the top of the jaw assembly 30, the barbed tab 66 spring back to their original conformation, and in doing so are effectively trapped above the top end 36 of the jaw assembly 30. Once the tabs 66 have been trapped, the jaw assembly 30 and sleeve 32 are necessarily interlocked, thus preventing the sleeve 32 from moving relative to or disengaging from the jaw assembly 30. As shown in FIG. 3, the interlocking string clamp apparatus 28 of the present invention is designed such that as the barb tabs 66 of the sleeve 32 engage the jaw assembly 30, and consequently interlock the two components in a final seated configuration, the jaw assembly 30 will be fully closed and gripping the string segment 34 with maximal gripping force. Once interlock has occurred, the string segment 34 may be released from the external tensioning device without significant loss of tension.

It should be appreciated that, as the purpose of the barbed tabs 66 is to engage and interlock with the jaw assembly 30, other features which provide positive clamping sleeve-to-jaw assembly interlock capability may be employed in the jaw assembly and clamping sleeve designs. For example, the clamping sleeve could incorporate a pair of tabs which are configured so as to engage and interlock with the jaw assembly as the clamping sleeve is rotated about a longitudinal axis relative to the jaw assembly. The clamping sleeve could also incorporate a pair of tabs which permanently deform upon engagement with the jaw assembly, thus providing positive interlock of the two components through much the same functional manner as the action of a conventional mechanical rivet.

Figure 4:
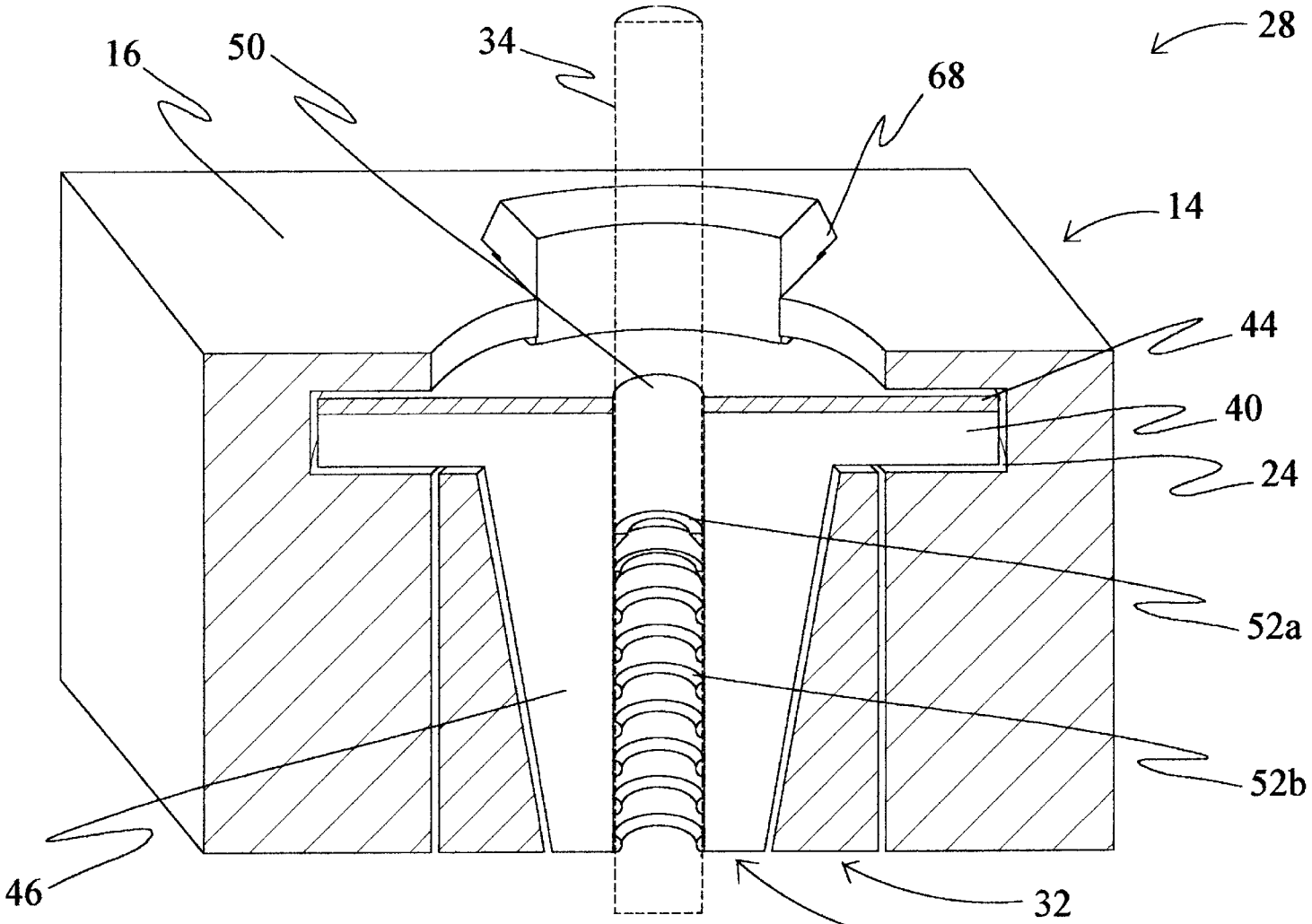
FIG. 4 is a sectioned, perspective view of an alternate embodiment of the interlocking string clamp apparatus of the present invention, illustrating the racquet frame, jaw assembly and clamping sleeve components following engagement and interlock of a clamping member fastener which secures the clamping member to the racquet frame.
Figure 5:
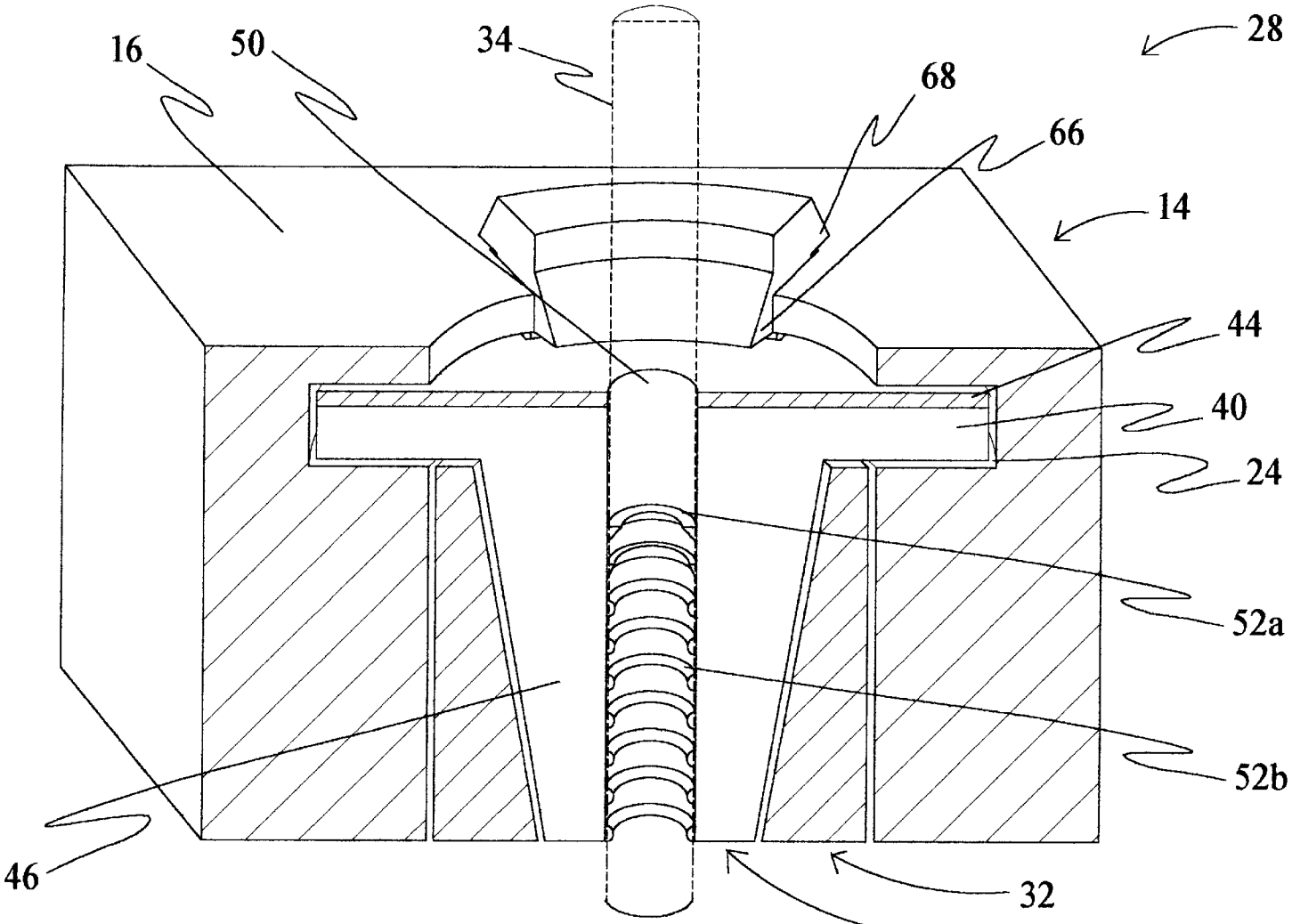
FIG. 5 is a sectioned, perspective view of an alternate embodiment of the interlocking string clamp apparatus of the present invention, illustrating the racquet frame, jaw assembly and clamping sleeve components following engagement and interlock of a pair of clamping member fasteners which secure the clamping member to both the racquet frame and the jaw assembly.

Furthermore, it should be appreciated that in an alternate embodiment, such as that illustrated in FIG. 4, the clamping sleeve 32 could be equipped with a barbed tab fastening feature 68, (sometimes referred to as a clamp-to-clamp fastener) which is so oriented as to engage and secure the clamping sleeve directly to the racquet frame 14. Also, shown in FIG. 5, is an alternate embodiment of the string clamping apparatus wherein the clamping sleeve 32 is equipped with a pair of barbed tab structures 66 and 68, which are oriented such that the barbed tab 66 engages and is secured to the jaw assembly 30, while the barbed tab 68 engages and is secured to the racquet frame 14.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A string clamping assembly for securing strings within a sports racquet having a surrounding frame structure which forms a racquet playing face and wherein said frame structure includes a series of spaced apart passageways formed therein, comprising:

a) a gripping wedge having a longitudinal throughway for receiving a string associated with the sports racquet;

b) the wedge including a fastener for securing the wedge directly to the passageway of the racquet frame structure such that the wedge engages and is seated within the passageway; and c) a clamping member for engaging the wedge and clamping the wedge down on the string for securing the string within the wedge and within the frame structure of the racquet.

2. The string clamping assembly of claim 1 wherein the clamping member includes a fastener for securing the clamping member to the wedge.

3. The string clamping assembly of claim 2 wherein the clamping member fastener assumes the form of a barbed tab.

4. The string clamping assembly of claim 1 wherein the clamping member includes a fastener for securing the clamping member to the frame structure.

5. The string clamping assembly of claim 4 wherein the clamping member fastener assumes the form of a barbed tab.

6. The string clamping assembly of claim 1 wherein the wedge fastener assumes the form of a tab for rotationally engaging a corresponding groove that is formed in the passageway.

7. The string clamping assembly of claim 1 wherein the gripping wedge is comprised of a plurality of tapered jaw members which together form a generally conical gripping jaw assembly.

8. The string clamping assembly of claim 7 wherein the clamping member assumes the form of a sleeve having an exterior surface generally corresponding with the shape of the passageways formed in the racquet frame structure and having a conical shaped interior surface which generally corresponds with the shape of the conical gripping jaw assembly.

9. The string clamping assembly of claim 1 wherein the wherein the surface of the gripping wedge throughway contains grip enhancing protrusions which extend generally upwardly and outwardly from the throughway surfaces so as to engage and grip the adjacently disposed string when the wedge is clamped onto the string by the clamping member.

10. The string clamping assembly of claim 9 wherein the grip enhancing protrusions are shaped so as to contact, but not penetrate the surface of the adjacently disposed string when the wedge is clamped onto the string by the clamping member.

11. The string clamping assembly of claim 9 wherein the grip enhancing protrusions are shaped so as to contact and penetrate the surface of the adjacently disposed string when the wedge is clamped onto the string by the clamping member.

12. The string clamping assembly of claim 9 wherein the grip enhancing protrusions that are disposed generally about the end of the wedge throughway which is oriented nearer to the racquet playing face are shaped so as to contact, but not penetrate the surface of the adjacently disposed string when the wedge is clamped onto the string by the clamping member, and wherein the grip enhancing protrusions that are disposed generally about the end of the wedge throughway which is oriented further from the racquet playing face are shaped so as to contact and penetrate the surface of the adjacently disposed string when the wedge is clamped onto the string by the clamping member.

13. A string clamping assembly for securing strings within a sports racquet having a surrounding frame structure which forms a racquet playing face and wherein said frame structure includes a series of spaced apart passageways formed therein, comprising:

a) a gripping wedge having a longitudinal throughway for receiving a string associated the sports racquet;

b) a clamping member for engaging the wedge and clamping the wedge down on the string so as to secure the string within the wedge and the frame structure of the racquet; and c) the clamping member including a fastener for engaging and connecting to the wedge such that the clamp and wedge are secured together within the passageway of the frame structure of the racquet.

14. The string clamping assembly of claim 13 wherein the clamping member fastener assumes the form of a barbed tab.

15. The string clamping assembly of claim 13 wherein the clamping member further includes a clamp-to-frame fastener for securing the clamping member to the frame structure.

16. The string clamping assembly of claim 15 wherein the clamp-to-frame fastener for securing the clamping member to the frame structure assumes the form of a barbed tab.

17. The string clamping assembly of claim 13 wherein the gripping wedge is comprised of a plurality of tapered jaw members which together form a generally conical gripping jaw assembly.

18. The string clamping assembly of claim 17 wherein the clamping member assumes the form of a sleeve having an exterior surface which generally corresponds with the shape of the passageways formed in the racquet frame structure and having a conical shaped interior surface which generally corresponds with the shape of the conical gripping jaw assembly.

19. The string clamping assembly of claim 13 wherein the wherein the surface of the gripping wedge throughway contains grip enhancing protrusions which extend generally upwardly and outwardly from the throughway surfaces so as to engage and grip the adjacently disposed string when the wedge is clamped onto the string by the clamping member.

20. The string clamping assembly of claim 19 wherein the grip enhancing protrusions are shaped so as to contact, but not penetrate the surface of the adjacently disposed string when the wedge is clamped onto the string by the clamping member.

21. The string clamping assembly of claim 19 wherein the grip enhancing protrusions are shaped so as to contact and penetrate the surface of the adjacently disposed string when the wedge is clamped onto the string by the clamping member.

22. The string clamping assembly of claim 19 wherein the grip enhancing protrusions that are disposed generally about the end of the wedge throughway which is oriented nearer to the racquet playing face are shaped so as to contact, but not penetrate the surface of the adjacently disposed string when the wedge is clamped onto the string by the clamping member, and wherein the grip enhancing protrusions that are disposed generally about the end of the wedge throughway which is oriented further from the racquet playing face are shaped so as to contact and penetrate the surface of the adjacently disposed string when the wedge is clamped onto the string by the clamping member.

23. A sports racquet formed by a process comprising:

a) a frame structure having a series of spaced apart passageways formed therein;

b) a series of clamping devices disposed in the respective passageways of the frame structure of the racquet for securing segments of a string to the frame structure;

c) each clamping device including:

i) a wedge having a throughway for receiving a string segment and disposed in a respective passageway formed in the frame structure; and ii) a clamp inserted between the wedge and the passageway for clamping the wedge against the string segment passing therethrough;

d) wherein each clamping device is inserted into a respective passageway of the frame structure by the process of:

i) inserting a string segment through the throughway of the wedge and inserting the wedge into a respective passageway in the racquet frame structure; and ii) after the wedge has been inserted into the passageway of the racquet frame structure, then inserting the clamp between the wedge and the passageway, thereby clamping the wedge against the string segment passing therethrough.

24. The sports racquet of claim 23 wherein the wedge includes a fastener for securing the wedge directly to the passageway of the frame structure of the racquet such that the wedge engages and is seated within the passageway.

25. The sports racquet of claim 23 wherein the clamping member includes a fastener for securing the clamping member to the wedge.

26. The sports racquet of claim 23 wherein the clamping member includes a fastener for securing the clamping member to the frame structure.

27. A sports racquet comprising:

a) an elongated handle;

b) a surrounding frame structure which forms a racquet playing face and wherein said frame structure includes a series of spaced apart passageways formed therein; and c) a series of string clamping assemblies for securing lengths of string to the frame structure, with each clamping assembly further comprising:

i) a gripping wedge having a longitudinal throughway for receiving a string associated with the sports racquet;

ii) the wedge including a fastener for securing the wedge directly to the passageway of the racquet frame structure such that the wedge engages and is seated within the passageway; and iii) a clamping member for engaging the wedge and clamping the wedge down on the string for securing the string within the wedge and within the frame structure of the racquet.

28. The sports racquet of claim 27 wherein the clamping member includes a fastener for securing the clamping member to the wedge.

29. The sports racquet of claim 27 wherein the clamping member includes a fastener for securing the clamping member to the frame.

30. A sports racquet comprising:

a) an elongated handle;

b) a surrounding frame structure which forms a racquet playing face and wherein said frame structure includes a series of spaced apart passageways formed therein; and c) a series of string clamping assemblies for securing lengths of string to the frame structure, with each clamping assembly further comprising:

i) a gripping wedge having a longitudinal throughway for receiving a string associated with the sports racquet;

ii) a clamping member for engaging the wedge and clamping the wedge down on the string so as to secure the string within the wedge and the frame structure of the racquet; and iii) the clamping member including a fastener for engaging and connecting to the wedge such that the clamp and wedge are secured together within the passageway of the frame structure of the racquet.

31. The sports racquet of claim 30 wherein the wedge includes a fastener for securing the wedge directly to the passageway of the frame structure of the racquet such that the wedge engages and is seated within the passageway.

32. The string clamping-assembly of claim 30 wherein the clamping member further includes a fastener for securing the clamping member to the frame structure.

* * * * *